US010544576B2

(12) United States Patent
Ismert et al.

(10) Patent No.: US 10,544,576 B2
(45) Date of Patent: Jan. 28, 2020

(54) LINEAR DRAIN ASSEMBLY

(71) Applicant: Sioux Chief Mfg. Co., Inc., Peculiar, MO (US)

(72) Inventors: Joseph N. Ismert, Stilwell, KS (US); Christopher P. Cucar, Kansas City, MO (US); Frank D. Julian, Kansas City, MO (US); Jeremiah T. Winnat, Garden City, MO (US); Christopher J. Ismert, Kansas City, MO (US)

(73) Assignee: Sioux Chief Mfg. Co., Inc., Peculliar, MO (US)

( * ) Notice: Subject to any disclaimer, the term of this patent is extended or adjusted under 35 U.S.C. 154(b) by 100 days.

(21) Appl. No.: 15/668,049

(22) Filed: Aug. 3, 2017

(65) Prior Publication Data

US 2018/0038091 A1 Feb. 8, 2018

Related U.S. Application Data

(60) Provisional application No. 62/371,603, filed on Aug. 5, 2016.

(51) Int. Cl.
*E03F 5/04* (2006.01)
*E03F 5/06* (2006.01)

(52) U.S. Cl.
CPC ..... *E03F 5/0408* (2013.01); *E03F 5/0404* (2013.01); *E03F 5/06* (2013.01)

(58) Field of Classification Search
CPC ..... E03F 5/0408; E03F 5/0401; E03F 5/0404; E03F 5/06; E03F 2005/0413
USPC ..... 4/613, 679
See application file for complete search history.

(56) References Cited

U.S. PATENT DOCUMENTS

| | | | |
|---|---|---|---|
| 2,701,027 | A | 2/1955 | Scoville |
| 4,190,988 | A | 3/1980 | Carreiro |
| 4,257,716 | A | 3/1981 | Woodrow |
| 5,340,234 | A | 8/1994 | Rossi et al. |
| 5,501,547 | A | 3/1996 | Mantelli |
| 5,529,436 | A | 6/1996 | Meyers |

(Continued)

FOREIGN PATENT DOCUMENTS

| | | | | |
|---|---|---|---|---|
| EP | 0677622 | A2 * | 10/1995 | ..... E03F 3/046 |
| JP | 2004011258 | A | 1/2004 | |

OTHER PUBLICATIONS

English translation of EP 0677622 A2 previously cited. (Year: 2019).*

*Primary Examiner* — Tuan N Nguyen
(74) *Attorney, Agent, or Firm* — Erickson Kernell IP, LLC; Kent R. Erickson

(57) ABSTRACT

A linear drain system that is configurable and adaptable on-site. The system includes an outlet section that is coupleable to a drain line of an existing plumbing system. The outlet section includes a pair of engagement flanges to which elongate channels are coupleable. The channels are easily cut to desired lengths on-site using hand tools or common power tools. Endcaps are coupled to terminal ends of the channels to form a trough. A strainer or a tile-ready strainer is provided for insertion into the trough. The strainer/tile-ready strainer are easily cut to length on-site as needed. A construction cover is provided that is disposable into the trough alone or overlying the strainer/tile-ready strainer to resist entrance of debris into the trough. The outlet section and channels include a longitudinal V-shaped canal.

20 Claims, 5 Drawing Sheets

(56) References Cited

U.S. PATENT DOCUMENTS

| | | | | |
|---|---|---|---|---|
| 6,027,283 | A | 2/2000 | Schweinberg et al. | |
| 6,612,780 | B2 | 9/2003 | Dahowski et al. | |
| 6,751,910 | B2 | 6/2004 | Richardson | |
| 7,306,401 | B1 | 12/2007 | Linkogle | |
| 7,748,170 | B1 | 7/2010 | Pratt | |
| 8,474,068 | B2 | 7/2013 | Kik, Sr. et al. | |
| 2011/0016622 | A1 | 1/2011 | Dallmer | |
| 2011/0067175 | A1* | 3/2011 | Steylaerts | E03F 5/0408 4/679 |
| 2011/0203979 | A1 | 8/2011 | Schlueter | |
| 2012/0110827 | A1* | 5/2012 | Doolittle | E03F 5/0408 29/527.1 |
| 2013/0032224 | A1 | 2/2013 | Andras et al. | |
| 2014/0352810 | A1 | 12/2014 | Wedi | |
| 2016/0130794 | A1* | 5/2016 | Erlebach | E03F 5/0408 4/613 |

* cited by examiner

LINEAR DRAIN ASSEMBLY

CROSS-REFERENCE TO RELATED APPLICATIONS

This application claims the benefit of U.S. Provisional Patent Application No. 62/371,603, filed Aug. 5, 2016 the disclosure of which is hereby incorporated herein in its entirety by reference.

BACKGROUND

Linear drains are employed in a variety of applications including showers, basements, driveways, sidewalks, pools, and the like. Installation of a linear drain often requires sizing of the drain to a desired length and coupling of the drain to a drainage system into which runoff captured by the drain can be flowed. Sizing of the drain may include cutting of a section of channel that forms the trough of the drain and coupling the channel with endcaps, connectors, or other fittings to provide the desired length and configuration. An outlet might also be formed in the channel, such as by drilling a hole through a wall thereof for coupling to the drainage system. A strainer grate is often placed over the channel to provide a finished look and to allow liquids to enter into the drain.

SUMMARY

Exemplary embodiments are defined by the claims below, not this summary. A high-level overview of various aspects thereof is provided here to introduce a selection of concepts that are further described in the Detailed-Description section below. This summary is not intended to identify key features or essential features of the claimed subject matter, nor is it intended to be used in isolation to determine the scope of the claimed subject matter. In brief, this disclosure describes, among other things, a linear drain system that is easily assembled and configured on-site.

The linear drain system includes an outlet section, a channel section, a pair of endcaps, and a strainer. The channel section forms the trough of the drain and includes a bottom wall with a profile having a depressed longitudinal central canal. The outlet section includes a raised central section having a profile matching that of the channel. A pair of support flanges extend longitudinally from opposite sides of the raised central section. A top surface of each support flange is recessed relative to a top surface of the raised central section a distance substantially equal to the thickness of the channel and is configured to receive a bottom surface of the channel thereon. The channel can thus be joined to the outlet portion by gluing or otherwise affixing to one of the support flanges.

The endcaps can be joined to distal ends of the channel to enclose ends of the channel and form the drain trough. Or the support flanges of the outlet section can be trimmed to enable coupling of the endcap thereto.

The strainer includes a planar top surface and a pair of downwardly depending flanges that are received within the channel. Adjustable legs may be provided on the strainer to adjust the height of the top surface relative to an adjacent flooring or other surface. The strainer may also be configured with a tile tray in which a tile or other floor covering may be installed.

DESCRIPTION OF THE DRAWINGS

Illustrative embodiments are described in detail below with reference to the attached drawing figures, and wherein.

DETAILED DESCRIPTION

Figure 1:
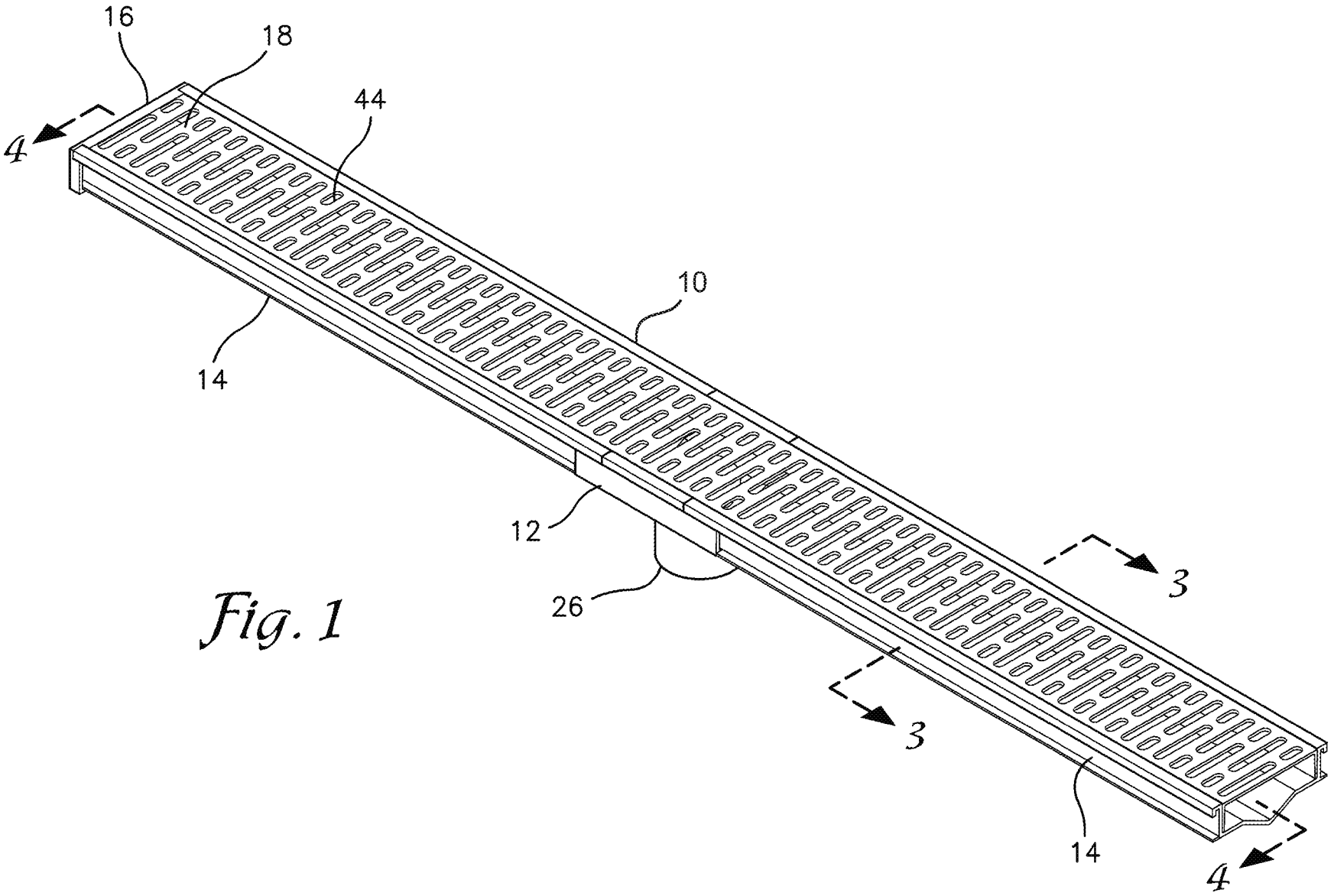
FIG. 1 is a perspective view of a linear drain with an endcap removed and depicted in accordance with an exemplary embodiment.
Figure 2:
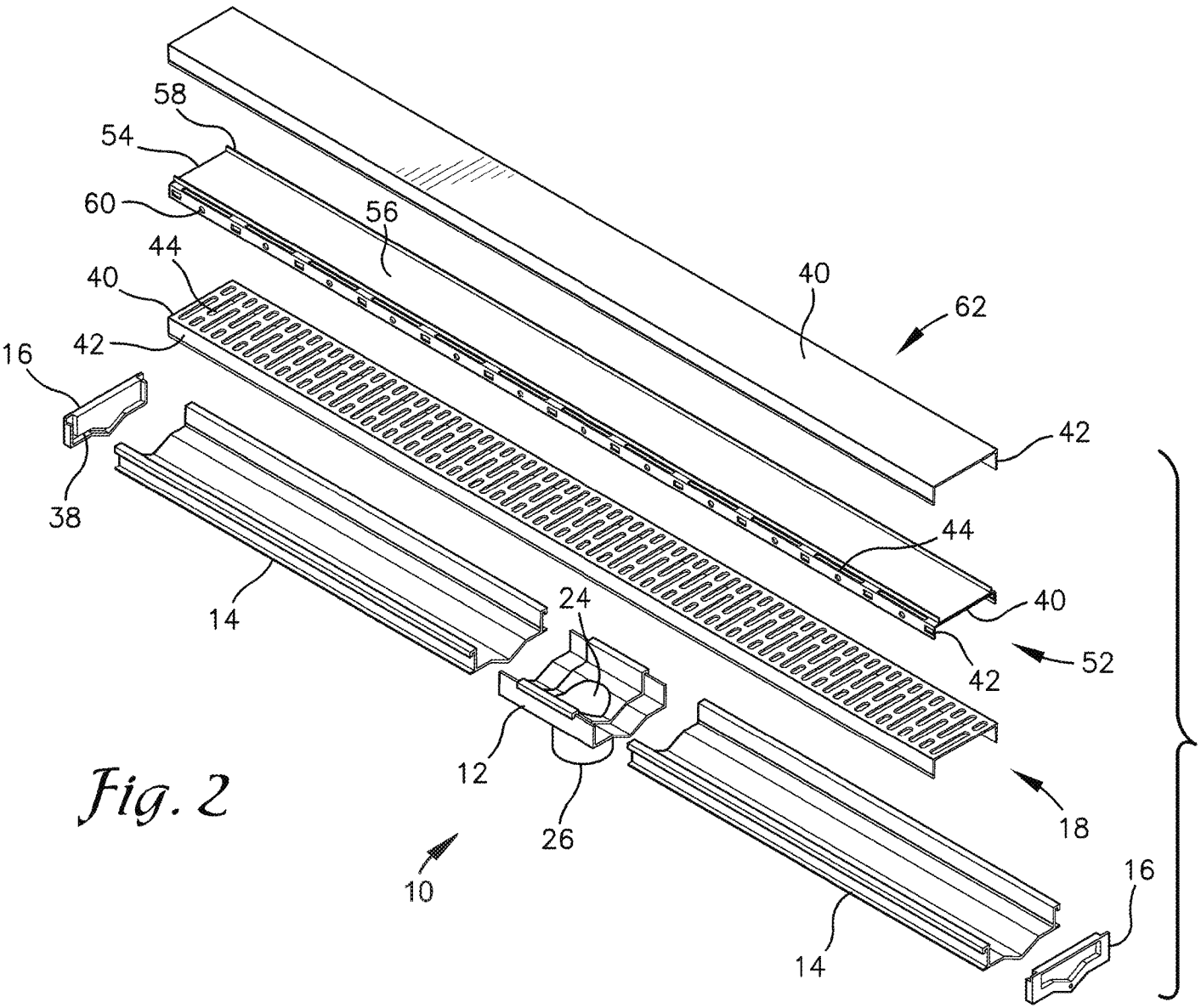
FIG. 2 is an exploded view of the linear drain of FIG. 1 depicting a strainer, a tile-ready strainer, and a construction cover that are interchangeably installable in the linear drain in accordance with an exemplary embodiment.

The subject matter of select exemplary embodiments is described with specificity herein to meet statutory requirements. But the description itself is not intended to necessarily limit the scope of claims. Rather, the claimed subject matter might be embodied in other ways to include different components, steps, or combinations thereof similar to the ones described in this document, in conjunction with other present or future technologies. Terms should not be interpreted as implying any particular order among or between various steps herein disclosed unless and except when the order of individual steps is explicitly described. The terms "about" or "approximately" as used herein denote deviations from the exact value by +/−10%, preferably by +/−5% and/or deviations in the form of changes that are insignificant to the function.

Exemplary embodiments are described herein with respect to the drawings in which reference numerals are employed to identify particular components or features. Similar elements in the various embodiments depicted are provided with reference numerals having matching second and third digits but with differing first digits, e.g. element 10 is similar to elements 110, 210, etc. Such is provided to avoid redundant description of similar features of the elements but is not intended to indicate the features or elements are necessarily the same.

With reference to FIGS. 1-5, a linear drain 10 is described in accordance with an exemplary embodiment. The linear drain 10 includes an outlet section 12, at least one channel 14, a pair of endcaps 16, and a strainer 18. All of the components 12, 14, 16, and 18 can be formed from materials commonly employed in plumbing or drainage fixtures, fittings, and piping, including, for example, polyvinyl chloride (PVC), chlorinated polyvinyl chloride (CPVC), and acrylonitrile butadiene styrene (ABS), among other plastics as well as from metal and composite materials such as stainless steel, copper, or the like. In one embodiment, the components 12, 14, 16, and 18 lend well to manufacture via injection molding and/or extrusion molding. The components 12, 14, 16, 18 may be constructed from dissimilar materials; for example, it may be preferable to produce the strainer 18 from a stainless steel or similar material for aesthetic and/or structural properties while the outlet section 12, the channels 14, and the endcaps 16 are formed from a plastic, such as PVC to decrease costs, ease manufacturing, and aid coupling to plumbing systems comprised of similar plastic materials.

The outlet section 12 comprises a central portion 20 with a support flange 22 extending longitudinally from opposite edges thereof. The central portion 20 extends transversely across the width of the outlet section 12 and forms an aperture 24 located centrally along the width. A tailpiece, conduit or outlet 26 configured for coupling with a drain pipe of a drainage system extends from a bottom surface of the central portion 20 with a bore therethrough positioned in coaxial alignment with the aperture 24. The outlet 26 can be configured for coupling to a drain pipe by means known in the art, such as gluing, solvent welding, welding, threaded coupling, fasteners, friction-fit, or the like.

The central portion 20 includes a transverse cross-sectional profile having a generally V-shaped central depression or canal 28 with substantially horizontally oriented floor sections 30 extending from opposite edges thereof. Substantially vertically oriented walls 32 extend upwardly from distal edges of the floor sections 30. It is understood, that the profile may take other similar forms without departing from the scope of exemplary embodiments described herein.

The support flanges 22 have a profile substantially identical to that of the central portion 20, but with a top surface that is recessed or stepped down relative to the top surface of the central portion 20. The top surface of the support flanges 22 is recessed a distance that is substantially equal to the thickness of the channel 14 such that, when the channel 14 is positioned on the support flange 22 a top surface of the channel 14 is substantially even with the top surface of the central portion 20 of the outlet section 12. The support flanges 22 may provide sufficient surface area on which to apply glues, adhesives, or other bonding agents for joining the channel 14 to the outlet section 12. In one embodiment, the vertically oriented walls 32 of the support flanges 22 are only partially recessed or are not recessed relative to the center portion 20.

In one embodiment, the outlet section 12 can be configured as a corner piece. For example, the central portion 20 may be formed such that the support flanges 22 extend therefrom at an angle, e.g. 90°, 45°, or another angle. As such, the linear drain 10 can be comprised of a plurality of linear sections that extend at angles to one another. The outlet section 12 might be configured without the aperture 24 and the outlet 26 and employed as a connector between two channels 14. In another embodiment, the outlet section 12 may be configured with more than two support flanges 22 and be useable to form a junction between three or more of the channels 14.

The channel 14 comprises an elongate member having a continuous cross-sectional profile with a top surface substantially matching that of the central portion 20 of the outlet section 12. A bottom surface of the channel 14 is configured to be received on the support flange 22 of the outlet section 12 and to couple thereto, such as by a glue or adhesive. The channel 14, thus includes the V-shaped central canal 28, the floor sections 30, and the walls 32 found in the central portion 20 of the outlet section 12. Top edges of the walls 32 may include a hooked flange 34 configured to receive a top edge of the support flange 22.

Figure 3:
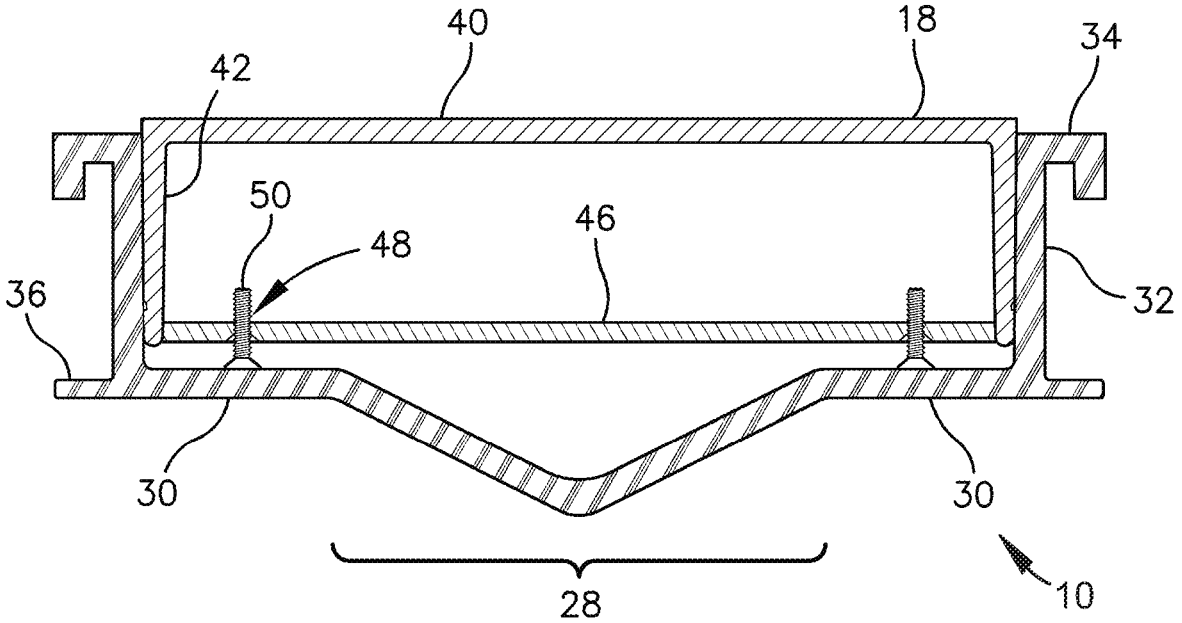
FIG. 3 is a transverse cross-sectional view of the linear drain of FIG. 1 taken along the line 3-3 shown in FIG. 1.
Figure 4:
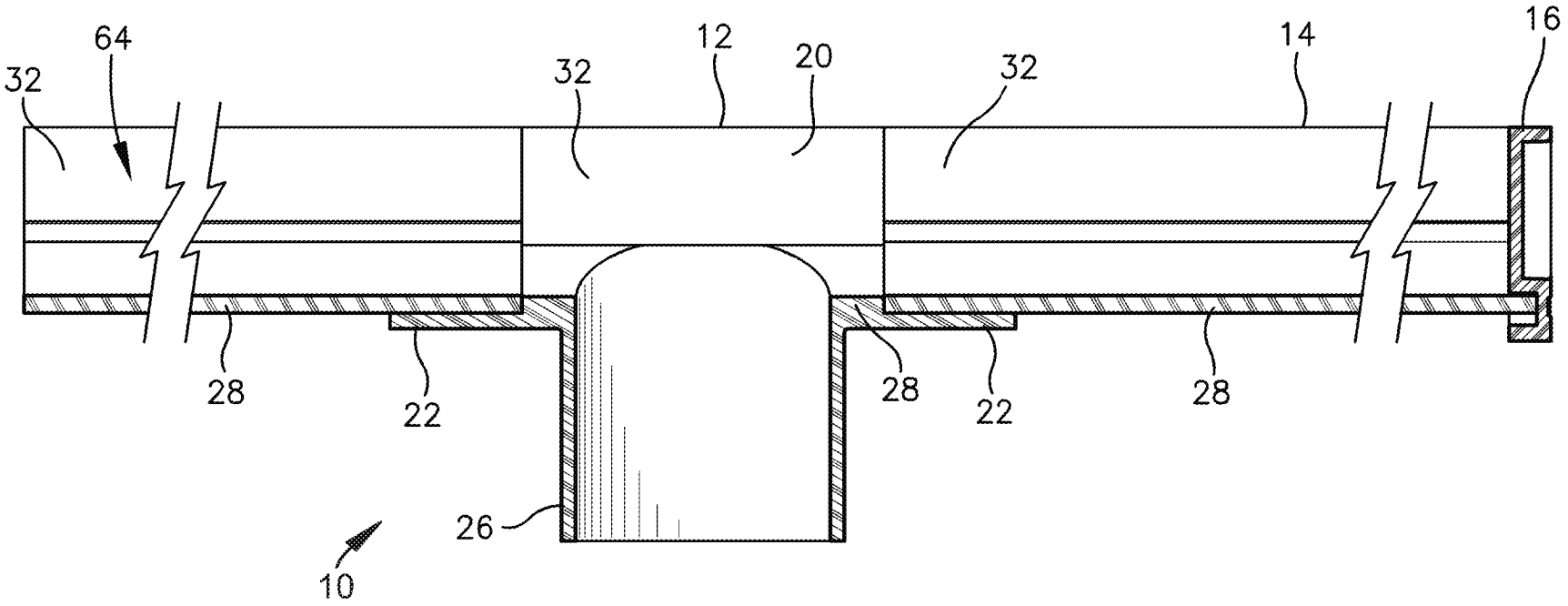
FIG. 4 is a longitudinal cross-sectional view of the linear drain of FIG. 1 taken along the line 4-4 and depicted with the strainer removed.
Figure 5:
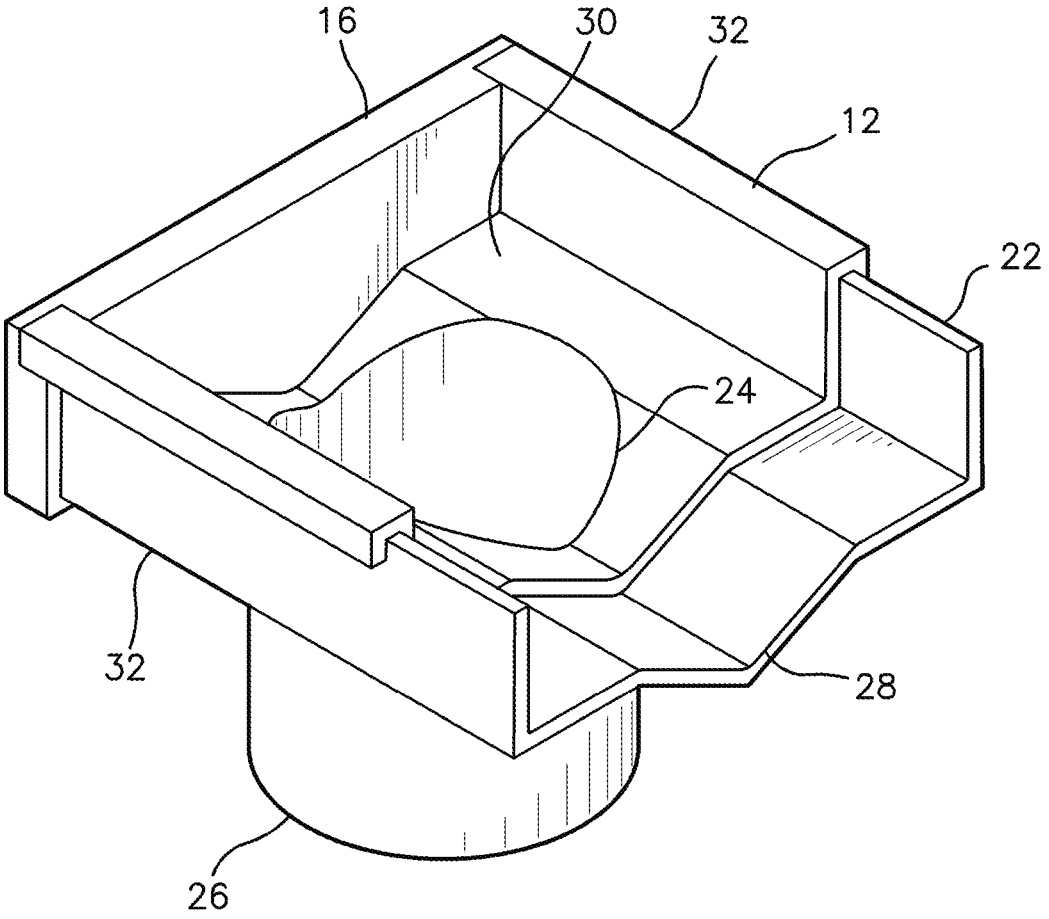
FIG. 5 is a perspective view of an outlet section of a linear drain with a support flange removed and an endcap coupled thereto depicted in accordance with an exemplary embodiment.

The channel 14 may include an anchor flange 36 extending laterally outward from an exterior surface of the walls 32. The anchor flange 36 may be configured to provide engagement between the channel 14 and flooring materials disposed around the linear drain 10, such as a bed of mortar, cement, subfloor paneling, or the like. For example, the anchor flange 36 may receive or engage the flooring materials thereon, such as by receiving a mortar or cement around or on a top surface of the flange 36. Fasteners, like nails or screws might also be driven through the anchor flange 36 and into a subflooring. The anchor flange 36 is depicted in FIGS. 3 and 5 as extending from a bottom edge of each of the vertical walls 32, however the anchor flange 36 may be positioned at any height along the vertical walls 32 and more than one anchor flange 36 may be provided on one or more of the vertical walls 32.

The endcap 16 is configured to couple to and enclose an end of the channel 14. The endcap 16 includes a recess 38 that substantially matches the profile of the channel 14 and into which the end of the channel 14 can be received. One or more glues, adhesives, or the like can be disposed in the recess 38 for coupling the endcap 16 to the channel 14 and to form a liquid-tight seal therebetween.

The strainer 18 comprises an elongate inverted channel having a top wall 40 with a pair of leg flanges 42 extending downwardly from opposite lateral edges thereof. A plurality of apertures 44 can be formed in the top wall 40 to provide openings through which fluids can flow into the channel 14 for drainage. The top wall 40 is dimensioned to place the leg flanges 42 between the walls 32 and in close proximity to and/or in contact with the walls 32 of the outlet section 12 or the channel 14. A plurality of cross-plates 46 may extend between the bottom edges of the leg flanges 42 at spaced apart locations along the length of the strainer 18. The cross-plates 46 may include a threaded bore 48 disposed near each end thereof into which a threaded adjustment foot 50 can be disposed.

In one embodiment, a tile-ready strainer 52 is provided instead of the strainer 18. The tile-ready strainer 52 is similarly configured to the strainer 18, e.g. the tile-ready strainer 52 includes the top wall 40 and the leg flanges 42 and may include the cross-plates 46 and the adjustment feet 50. But the tile-ready strainer 52 includes a tile tray 54 disposed on or formed by the top wall 40. The tile tray 54 includes a bottom wall 56 (which may comprise the all or a portion of the top wall 40) with a pair of flanges 58 extending upwardly from opposite edges thereof to form a channel within which grout and tile or other finish-flooring materials can be disposed. The tile tray 54 may be dimensioned with a width that is less than that of the top wall 40 such that the apertures 44 can be provided alongside the tile tray 54 to allow water to drain into the channel 14 or the outlet section 12. Additional apertures 60 may also be provided in the leg flanges 42 to aid drainage.

In another embodiment, a temporary construction cover 62 is provided. The construction cover 62 is configured like the strainer 18, but without the apertures 44. As such, the construction cover 62 can be installed during construction of the structure in which the linear drain 10 is incorporated to prevent or reduce the amount of construction debris that enter the linear drain 10 and/or the associated plumbing system and may prevent or reduce damage to the linear drain 10 that may occur during construction. The construction cover 62 can be replaced by the strainer 18 or the tile-ready strainer 52 at a desired time, typically at or near the end of construction activities. The construction cover 62 may also be manufactured from less expensive materials than the strainer 18, such as a plastic rather than a stainless steel.

With continued reference to FIGS. 1-5, installation and operation of the linear drain 10 is described in accordance with an exemplary embodiment. The outlet section 12 is coupled to the drain line of the plumbing system in the structure in which the linear drain 10 is to be installed. The coupling can be completed via available methods. In some embodiments, more than one outlet section 12 can be incorporated into a particular linear drain 10 installation.

The desired length of the channels 14 is determined. The channels 14 can be cut to the desired length on-site using simple hand tools and/or saws. The channels 14 need not be pre-sized before transport to a construction site and/or during manufacturing for a particular application and do not require specialized equipment for cutting and fitting to the installation dimensions. A portion of the anchor flanges 36 may require trimming so as not to obstruct disposal of the channel 14 on the support flange 22.

Adhesives, glues, or similar bonding agents are applied to the support flanges 22 and/or the respective ends of the channels 14 to couple the channels 14 to the respective support flanges 22. Coupling of the channels 14 to the support flanges 22 provides a liquid-tight seal between the channels 14 and the outlet section 12 and forms a substantially continuous top surface formed by the top surfaces of the central portion 20 of the outlet section and the channels 14. The bonding agent is preferably applied along the entire transverse dimension of the support flange 22 including the vertically oriented walls 32 to provide a continuous barrier to fluid flow between the channel 14 and the support flange 22. The bonding agent may be applied on and around top distal edges of the vertically oriented walls 32 to create a bond between the support flange 22 and the hooked flanges 34 and thereby continue the barrier to fluid flow up to and/or around the top distal edge of the support flange 22.

The endcaps 16 are coupled to respective ends of the channels 14. A glue, adhesive, or similar bonding agent is disposed in the recess 38 in the endcap 16 and the endcap 16 is installed on the end of the channel 14 to form a liquid-tight seal therebetween. In some embodiments, a portion of the anchor flange 36 on the channels 14 is removed before coupling with the endcap 16 so as not to interfere or obstruct insertion of the end of the channel 14 into the recess 38 in the endcap 16.

In one embodiment, it is desirable to place the outlet section 12 and the outlet 26 at an end of the linear drain 10. To accomplish this installation, one of the support flanges 22 is trimmed off of the outlet section 12, such as by using a razor knife, saw, clippers, or the like. The endcap 16 can then be coupled directly to the outlet section 12. The channel 14 can be coupled to the remaining support flange 22 and further construction can proceed as described herein.

The outlet section 12, the channels 14, and the endcaps 16 form a basin or trough 64 into which liquids may be disposed or directed. The V-shaped central canal 28 aids channeling of the liquids toward a longitudinal centerline of the linear drain 10 and into the plumbing system via the aperture 24 in the outlet section 12. The channels 14 can be installed in a substantially level orientation, e.g. no draft or slope toward the outlet section 12 is required. Small quantities of fluid may remain in the trough 64 but are minimized by the V-shaped central canal 28 and are inconsequential to the operation of the linear drain 10.

If construction activities are in progress after installation of the linear drain 10 the construction cover 62 can be installed in the trough 64. The construction cover 62 can be provided in lengths greater than that of the linear drain 10 and cut to size on-site as needed. Or a plurality of sections of the construction cover 62 can be provided and installed and/or cut to length on-site as needed. The construction cover 62 substantially prevents entrance of debris into the trough 64 during the construction and/or cleanup activities.

Upon substantial completion of the construction activities the construction cover 62 can be removed and replaced with the strainer 18. Like the construction cover 62, the strainer 18 can be provided in a single longer piece that can be cut to length on-site or a plurality of shorter pieces can be provided and fit to the linear drain 10.

The height of the strainer 18 relative to the surrounding flooring surface can be adjusted by installation of the adjustment feet 50 in the cross-plates 46. The adjustment feet 50 contact the floor sections 30 of the channels 14 and/or the outlet section 12 and support the strainer 18 thereabove. As shown, the adjustment feet 50 are threadably rotatable relative to the cross-plates 46 to adjust their extension from the cross-plates 46 and thus the height of the top wall 40 of the strainer 18 above the floor sections 30, however other adjustment mechanisms may be employed.

Alternatively, when it is desired to provide a tiled or other masonry-covered appearance to the linear drain 10, the construction cover 62 can be replaced by the tile-ready strainer 52. Like the construction cover 62 the tile-ready strainer 52 can be provided in a single longer piece that can be cut to length on-site or a plurality of shorter pieces can be provided and fit to the linear drain 10.

Tile or other masonry can be installed in the tile tray 54 of the tile-ready strainer 52. The tile tray 54 provides a channel or trough in which a grout or similar material can be disposed and tiles/masonry applied thereon by methods known in the art. The thickness of the grout and/or the tile/masonry applied can be managed to provide an overall height at the desired level, e.g. substantially equal to that of the surrounding flooring. The tile-ready strainer 52 may also be provided with the adjustment feet 50 to adjust the height thereof relative to a surrounding flooring surface.

In another embodiment, the strainer 18 or the tile-ready strainer 52 are dimensioned to provide a small gap between their leg flanges 42 and the walls 32 of the channel 14 and/or outlet section 12. And the leg flanges 42 of the construction cover 62 have a thickness configured to fit within the small gaps. As such, the strainer 18 or tile-ready strainer 52 can be installed in the trough 64 and the construction cover 62 disposed on top of the strainer 18/tile-ready strainer 52 to resist entrance of debris into the trough 64 and to protect the strainer 18/tile-ready strainer 52 from damage during construction activities. This configuration also reduces risks of losing or damaging the strainer 18/tile-ready strainer 52 during construction activities because the strainer 18/tile-ready strainer 52 does not have to be stored separate from the linear drain 10 either on- or off-site.

Many different arrangements of the various components depicted, as well as components not shown, are possible without departing from the scope of the claims below. Embodiments of the technology have been described with the intent to be illustrative rather than restrictive. Alternative embodiments will become apparent to readers of this disclosure after and because of reading it. Alternative means of implementing the aforementioned can be completed without departing from the scope of the claims below. Identification of structures as being configured to perform a particular function in this disclosure and in the claims below is intended to be inclusive of structures and arrangements or designs thereof that are within the scope of this disclosure and readily identifiable by one of skill in the art and that can perform the particular function in a similar way. Certain features and sub-combinations are of utility and may be employed without reference to other features and sub-combinations and are contemplated within the scope of the claims.

What is claimed is:

1. A floor drain assembly comprising:

an elongate channel section forming a trough, the trough having an interior surface profile that includes a substantially planar trough floor with a longitudinally extending canal formed in the trough floor and a pair of wall sections extending substantially vertically upward from opposing longitudinal edges of the trough floor;

a strainer disposed in the trough to overlie the trough floor, the strainer including a planar top wall with a pair of first leg flanges extending orthogonally from opposing longitudinal edges of the top wall; and a construction cover that includes a solid planar cover wall with a pair of second leg flanges extending orthogonally from longitudinal edges thereof, the construction cover being dimensioned to extend substantially between the wall sections of the trough to substantially enclose the trough of the channel section against entry of debris, the cover wall of the construction cover overlying the strainer.

2. The floor drain assembly of claim 1, further comprising:

an outlet section having a second interior surface profile that is substantially the same as the interior surface profile of the channel section, the outlet section including a support flange extending from a transverse edge of the outlet section, a top surface of the support flange being recessed to receive an end of the channel section thereon with interior surfaces of the channel section and the outlet section being substantially aligned.

3. The floor drain assembly of claim 2, wherein the channel section is coupled to the support flange using one or more adhesives.

4. The floor drain assembly of claim 2, wherein the outlet section includes a conduit extending from a bottom surface thereof that is coupleable to a plumbing system and that forms a bore that extends through the interior surface of the outlet section, and wherein the canal intersects the bore.

5. The floor drain assembly of claim 1, further comprising:

an endcap that is sized to substantially enclose an end of the trough formed by the channel section, the endcap including a recess configured to receive a distal edge of the channel section.

6. The floor drain assembly of claim 5, wherein the endcap is affixed to the channel section by one or more adhesives disposed in the recess.

7. The floor drain assembly of claim 1, wherein the longitudinally extending canal is substantially V-shaped.

8. The floor drain assembly of claim 1, wherein the strainer includes a plurality of cross-plates spaced apart along the length of the strainer and extending between distal edges of the first leg flanges; and an adjustment foot disposed in each of the cross-plates, the foot being extendable from the respective cross-plate to adjust a height of the top wall of the strainer above the trough floor of the channel section.

9. The floor drain assembly of claim 8, wherein the top wall of the strainer includes a plurality of apertures configured to allow a flow of fluids into the channel section.

10. The floor drain assembly of claim 8, wherein the top wall of the strainer is configured to receive a finish flooring material thereon.

11. The floor drain assembly of claim 10, wherein the strainer includes a pair of tile-tray flanges extending upwardly from opposing longitudinal edges of the top wall of the strainer between which the finish flooring material can be disposed.

12. The floor drain assembly of claim 1, wherein the construction cover is dimensioned to place the second leg flanges between and abutting the wall sections, and wherein the strainer is dimensioned to provide space between the leg flanges and the wall sections sufficient to enable installation of the construction cover with the cover wall overlying the strainer and with the second leg flanges of the construction cover disposed between the respective first leg flanges of the strainer and the respective wall sections of the trough.

13. The floor drain assembly of claim 1, wherein the second leg flanges are disposed between and abutting the wall sections of the channel section.

14. The floor drain assembly of claim 1, wherein the channel section includes an anchor flange extending outwardly from an exterior surface of at least one of the wall sections.

15. A floor drain assembly comprising:

an outlet section having a central portion and a support flange, the central portion forming a first portion of a drain trough including a first interior surface profile with a substantially planar horizontally extending floor, a longitudinally extending canal formed in the floor and a pair of wall sections extending substantially vertically upward from opposing longitudinal edges of the floor, and the central portion including a conduit extending from a bottom surface thereof that is coupleable to a plumbing system and that forms a bore that is intersected by the canal in the central portion of the outlet section, the support flange extending from a transverse edge of the central portion, an interior surface of the support flange being recessed relative to an interior surface of the central portion;

an elongate channel section forming a second portion of the drain trough having a second interior surface profile that is substantially the same as the first interior surface profile of the central portion, a first end of the channel section being disposed on the support flange with an interior surface of the channel section being substantially aligned with the interior surface of the central portion;

a strainer including a planar top wall with a pair of first leg flanges extending orthogonally from opposing longitudinal edges thereof, the strainer having dimensions sufficient to provide a length that extends longitudinally across at least the length of the central portion of the outlet section and of the channel section and a width sufficient to provide a space between each of the pair of first leg flanges and respective adjacent ones of the sidewalls of the drain trough; and a construction cover that includes a solid planar cover wall with a pair of second leg flanges extending orthogonally from longitudinal edges thereof, the construction cover being dimensioned to extend substantially between the wall sections of the drain trough to place the second leg flanges between and abutting the wall sections and to substantially enclose the trough of the channel section against entry of debris, the second leg flanges being disposed in the spaces between the first leg flanges and the respective adjacent wall sections, the cover wall of the construction cover overlying the strainer.

16. The floor drain assembly of claim 15, wherein the canal is substantially V-shaped and aids drainage of liquids toward the plumbing system by channeling of small amounts of liquid together.

17. The floor drain assembly of claim 15, wherein the central portion of the outlet section and the channel section are installed without a draft toward the bore.

18. The floor drain assembly of claim 15, further comprising:

a plurality of cross-plates spaced apart along the length of the strainer and extending between distal edges of the first leg flanges; and an adjustment foot disposed in each of the cross-plates, the foot being extendable from the respective cross-plate to adjust a height the top wall of the strainer above the floor.

19. The floor drain assembly of claim 18, wherein the top wall of the strainer is configured to receive a finish flooring material thereon.

20. A floor drain assembly comprising:

an elongate channel section forming a trough with a substantially planar floor that is bisected by a longitudinally extending canal formed therein, the trough including a pair of wall sections extending substantially vertically upward from opposing longitudinal edges of the floor;

a strainer disposed in the trough and including a planar top wall with a pair of first leg flanges extending orthogonally from opposing longitudinal edges thereof and toward the floor, the strainer further including a plurality of cross-plates spaced apart along the length of the strainer and extending between distal edges of the first leg flanges, each of the cross-plates including an adjustment foot that is extendable to adjust a height the top wall of the strainer above the floor; and a construction cover that includes a solid planar cover wall with a pair of second leg flanges extending orthogonally from longitudinal edges thereof, the construction cover being dimensioned to extend substantially between the wall sections of the drain trough to place the second leg flanges between and abutting the wall sections and in the spaces between respective ones of the wall sections and the first leg flanges, the cover wall of the construction cover overlying the strainer to substantially enclose the trough of the channel section against entry of debris.

* * * * *